US011492844B2

(12) United States Patent
Chen

(10) Patent No.: US 11,492,844 B2
(45) Date of Patent: Nov. 8, 2022

(54) VENETIAN BLIND CAPABLE OF FACILITATING INCLINATION ANGLE ADJUSTMENT OF SLATS

(71) Applicant: SHEEN WORLD TECHNOLOGY CORPORATION, Taichung (TW)

(72) Inventor: Po-Yu Chen, Taichung (TW)

(73) Assignee: SHEEN WORLD TECHNOLOGY CORPORATION, Taichung (TW)

( * ) Notice: Subject to any disclaimer, the term of this patent is extended or adjusted under 35 U.S.C. 154(b) by 0 days.

(21) Appl. No.: 17/150,065

(22) Filed: Jan. 15, 2021

(65) Prior Publication Data

US 2022/0228432 A1 Jul. 21, 2022

(51) Int. Cl.
*E06B 9/322* (2006.01)
*E06B 9/326* (2006.01)
*E06B 9/307* (2006.01)

(52) U.S. Cl.
CPC ..... *E06B 9/322* (2013.01); *E06B 9/307* (2013.01); *E06B 9/326* (2013.01)

(58) Field of Classification Search
CPC ..... E06B 9/304; E06B 9/307; E06B 9/303; E06B 9/322; E06B 9/326
See application file for complete search history.

(56) References Cited

U.S. PATENT DOCUMENTS 138,761 A * 5/1873 Potter, Jr. ..... E06B 9/303 160/168.1 R
153,382 A * 7/1874 Scranton ..... E06B 9/307 160/177 R
1,727,699 A * 9/1929 Daniel ..... E06B 9/307 160/176.1 R
1,772,493 A * 8/1930 Leeper ..... E06B 9/307 160/175
1,957,272 A * 5/1934 Kuyper ..... E06B 9/303 160/176.1 R
2,227,211 A * 12/1940 Balthasar ..... E06B 9/307 160/176.1 R
2,831,536 A * 4/1958 Lorentzen ..... E06B 9/307 160/177 R (Continued)

FOREIGN PATENT DOCUMENTS

TW M551651 U 11/2017
TW M569787 U 11/2018

*Primary Examiner* — Johnnie A. Shablack
*Assistant Examiner* — Abe Massad
(74) *Attorney, Agent, or Firm* — Browdy and Neimark, PLLC

(57) ABSTRACT

A Venetian blind includes a plurality of slats arranged between a headrail and a bottom rail. Two rotary drums are disposed in two brackets mounted in the headrail and connected with each other through a transmission shaft. A first drawing member is connected with one rotary drum, and a second drawing member is connected with the other rotary drum. When the first drawing member is pulled downward, the rotary drums are rotated from a first position to a second position, such that the ladder cords are driven by the rotation of the rotary drums to tilt the slats to a closed position. When the second drawing member is pulled downward, the rotary drums are rotated from the second position to the first position, such that the ladder cords are driven by the rotation of the rotary drums to tilt the slats to an open position.

4 Claims, 12 Drawing Sheets

(56) References Cited

U.S. PATENT DOCUMENTS

| | | | | | |
|---|---|---|---|---|---|
| 4,377,194 | A * | 3/1983 | Tsuhako | E06B 9/307 | 160/176.1 R |
| 4,643,238 | A * | 2/1987 | Tachikawa | E06B 9/307 | 160/168.1 R |
| 5,232,037 | A * | 8/1993 | Fraser | E06B 9/307 | 160/176.1 R |
| 5,485,874 | A * | 1/1996 | Whitmore | E06B 9/303 | 160/178.3 |
| 5,611,381 | A * | 3/1997 | Jelic | E06B 9/264 | 160/178.1 R |
| 6,845,802 | B1 * | 1/2005 | Anderson | E06B 9/322 | 160/115 |
| 7,832,453 | B2 * | 11/2010 | Lin | E06B 9/307 | 160/176.1 R |
| 2002/0020506 | A1 * | 2/2002 | Dekker | E06B 9/307 | 160/115 |
| 2018/0073295 | A1 * | 3/2018 | Nien | E06B 9/382 | |
| 2018/0112460 | A1 * | 4/2018 | Huang | E06B 9/303 | |

* cited by examiner

VENETIAN BLIND CAPABLE OF FACILITATING INCLINATION ANGLE ADJUSTMENT OF SLATS

BACKGROUND OF THE INVENTION

1. Field of the Invention

The present invention relates to window blinds and more particularly, to a Venetian blind that is easy to adjust the inclination angle of slats.

2. Description of the Related Art

In order to adjust the indoor ambient light at any time, TW patent No. M569787 and TW patent No. M551651 disclose slat angle adjustment mechanisms that are used to adjust the angle of the slats of a window blind. Simply speaking, the conventional slat angle adjustment mechanism generally comprises a casing, a worm wheel, and a worm shaft. The casing is mounted in the headrail of the window blind. The worm wheel is rotatably mounted in the casing. The worm shaft has a worm located at one end thereof and inserted into the inside of the casing and meshed with the worm wheel, and an opposite end thereof protruded out of the casing and suspended outside the headrail for the hooking of a rotary handle that is driven by a user to rotate the worn shaft and the worm wheel, causing a connected transmission member to bias the slats of the window blind.

However, as the worm shaft and the worm wheel have been installed in the casing in the factory, the protruded worm shaft can easily be damaged or can damage the slats of the window blind accidentally during packaging or delivery. An improvement in this regard is desired.

SUMMARY OF THE INVENTION

It is a primary objective of the present invention to provide a Venetian blind, which has a simple structure and is convenient in operation and prevents slats from damaging during packaging or delivery.

To attain the above objective, the present invention provides a Venetian blind comprises a headrail, a bottom rail, a plurality of slats arranged between the headrail and the bottom rail, a slat angle adjustment device, a first drawing member, and a second drawing member. The slat angle adjustment device includes two brackets, a first rotary drum, a second rotary drum, a transmission shaft, and two ladder cords. The brackets are mounted in the headrail and located at left and right ends of the headrail. The first and second rotary drums are rotatably disposed in the brackets and connected with each other through the transmission shaft, such that the first and second rotary drums are rotated synchronously between a first position and a second position. The ladder cords each have a front warp, a rear warp, and a plurality of wefts connected between the front and rear warps. The front and rear warps are located at the front and rear sides of the slats, and the top ends of the front and rear warps are connected with the first and second rotary drums, and the bottom ends of the front and rear warps are connected with the bottom rail, and each of the wefts is abutted against the bottom side of one of the slats. By this way, when the first and second rotary drums are located at the first position, the ladder cords are driven by the first and second rotary drums to move the slats to an open position, and when the first and second rotary drums are located at the second position, the ladder cords are driven by the first and second rotary drums to move the slats to a closed position. The first drawing member is suspended in front of the slats and has a top end thereof connected to the first rotary drum. The second drawing member is suspended in front of the slats and has a top end thereof connected to the second rotary drum.

It can be understood from the above illustration that if a user would like to close the slats, pulling the first drawing member downward for driving the first rotary drum to rotate from the first position to the second position, such that the second rotary drum is rotated along with the first rotary drum through the transmission shaft. As a result, the ladder cords are driven by the rotation of the first and second rotary drums to tilt the slats to the closed position. Next, if the user would like to open the slats, pulling the second drawing member downward for driving the second rotary drum to rotate from the second position to the first position, such that the first rotary drum is rotated along with the second rotary drum through the transmission shaft. Thus, the ladder cords are driven by the rotation of the first and second rotary drums to tilt the slats to the open position. Further, since the first and second drawing members are suspended in front of the slats, this design can prevent the slats from deforming or damaging during packaging or delivery.

Preferably, the first drawing member and the second drawing member are belts. The belts can be made of leather, cloth or elastic material.

Preferably, the first drawing member is wound around the top and rear sides of the first rotary drum and connected with the bottom side of the first rotary drum, such that the first rotary drum is driven by the first drawing member to rotate from top to bottom. The second drawing member is wound around bottom and rear sides of the second rotary drum and connected with a top side of the second rotary drum, such that the second rotary drum is driven by the second drawing member to rotate from bottom to top.

Preferably, the left end of the headrail has one through hole for penetration of the first drawing member to avoid mutual interference between the headrail and the first drawing member. The right end of the headrail has the other through hole for penetration of the second drawing member to avoid mutual interference between the headrail and the second drawing member.

Preferably, the first drawing member has a first hollow slot at the top end thereof for receiving parts of the front and rear warps of the left ladder cord to avoid mutual interference between the first drawing member and the front and rear warps of the left ladder cord.

Preferably, the second drawing member has a second hollow slot at the top end thereof for receiving parts of the front and rear warps of the right ladder cord to avoid mutual interference between the second drawing member and the front and rear warps of the right ladder cord.

Other advantages and features of the present invention will be fully understood by reference to the following specification in conjunction with the accompanying drawings, in which like reference signs denote like components of structure.

DETAILED DESCRIPTION OF THE INVENTION

Figure 1:
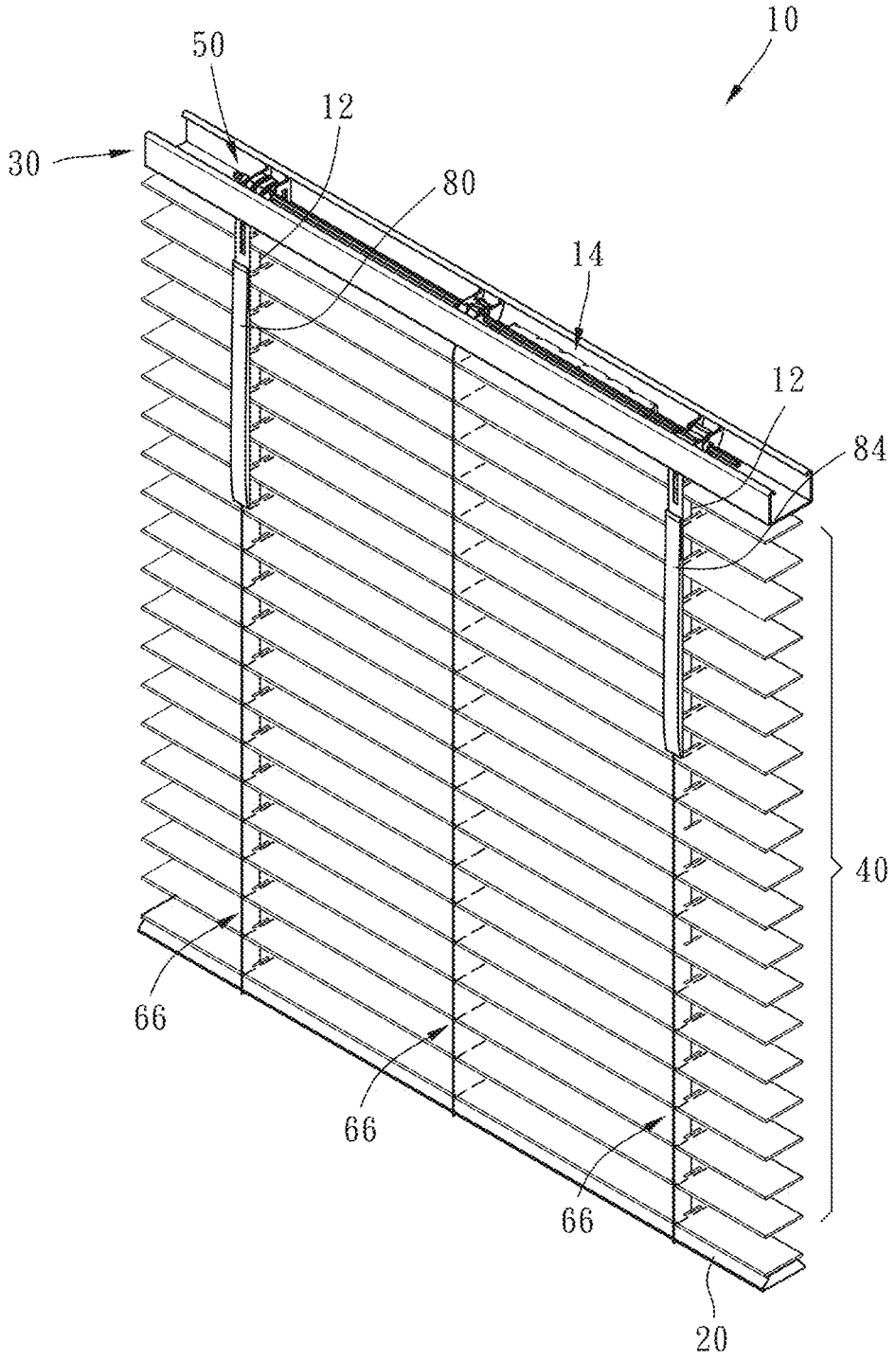
FIG. 1 is a perspective view of a Venetian blind of the present invention.
Figure 2:
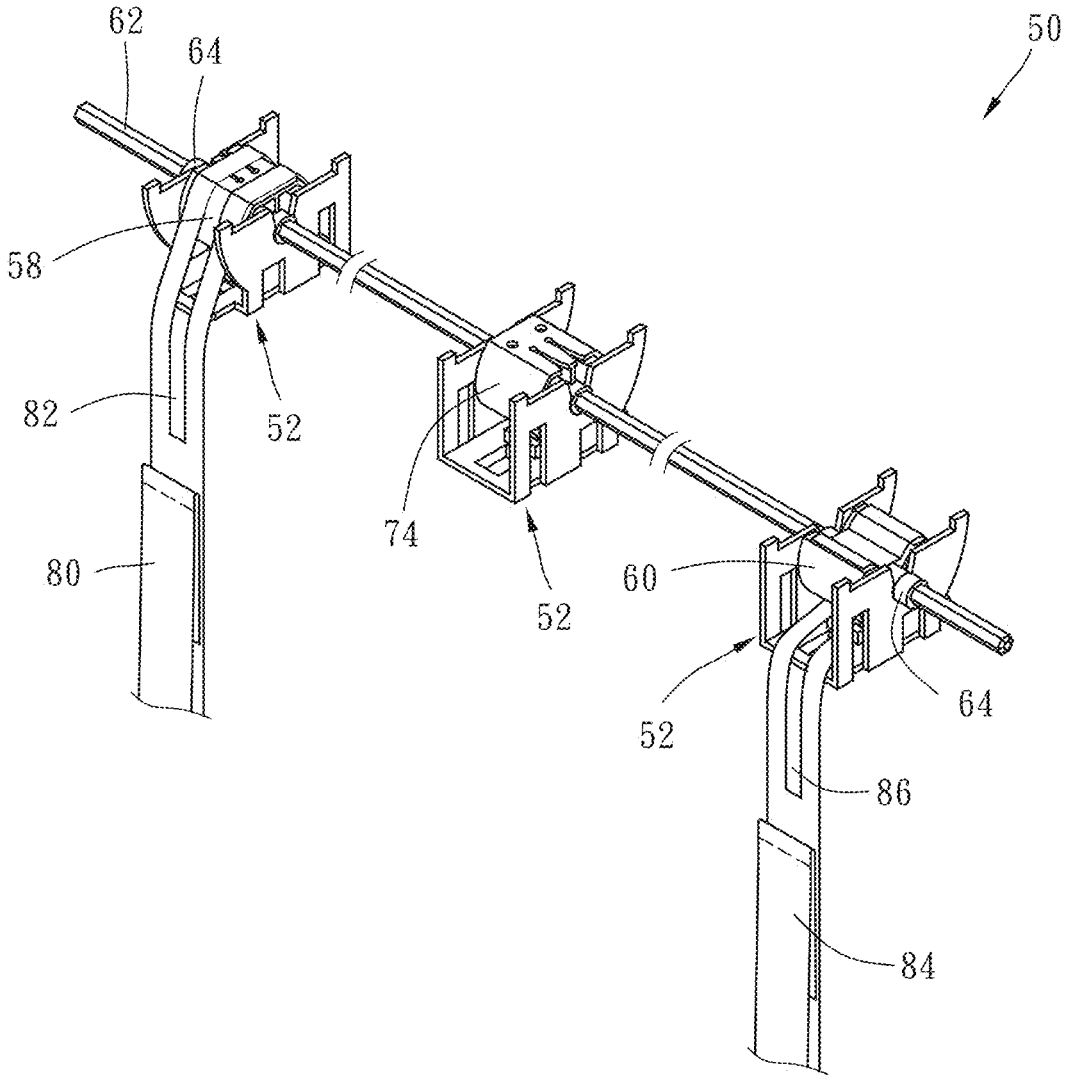
FIG. 2 is a perspective view of a part of the Venetian blind of the present invention.

Referring to FIGS. 1 and 2, a Venetian blind 10 of the present invention comprises a bottom rail 20, a headrail 30, a plurality of slats 40, a slat angle adjustment device 50, a first drawing member 80, and a second drawing member 84.

Figure 3:
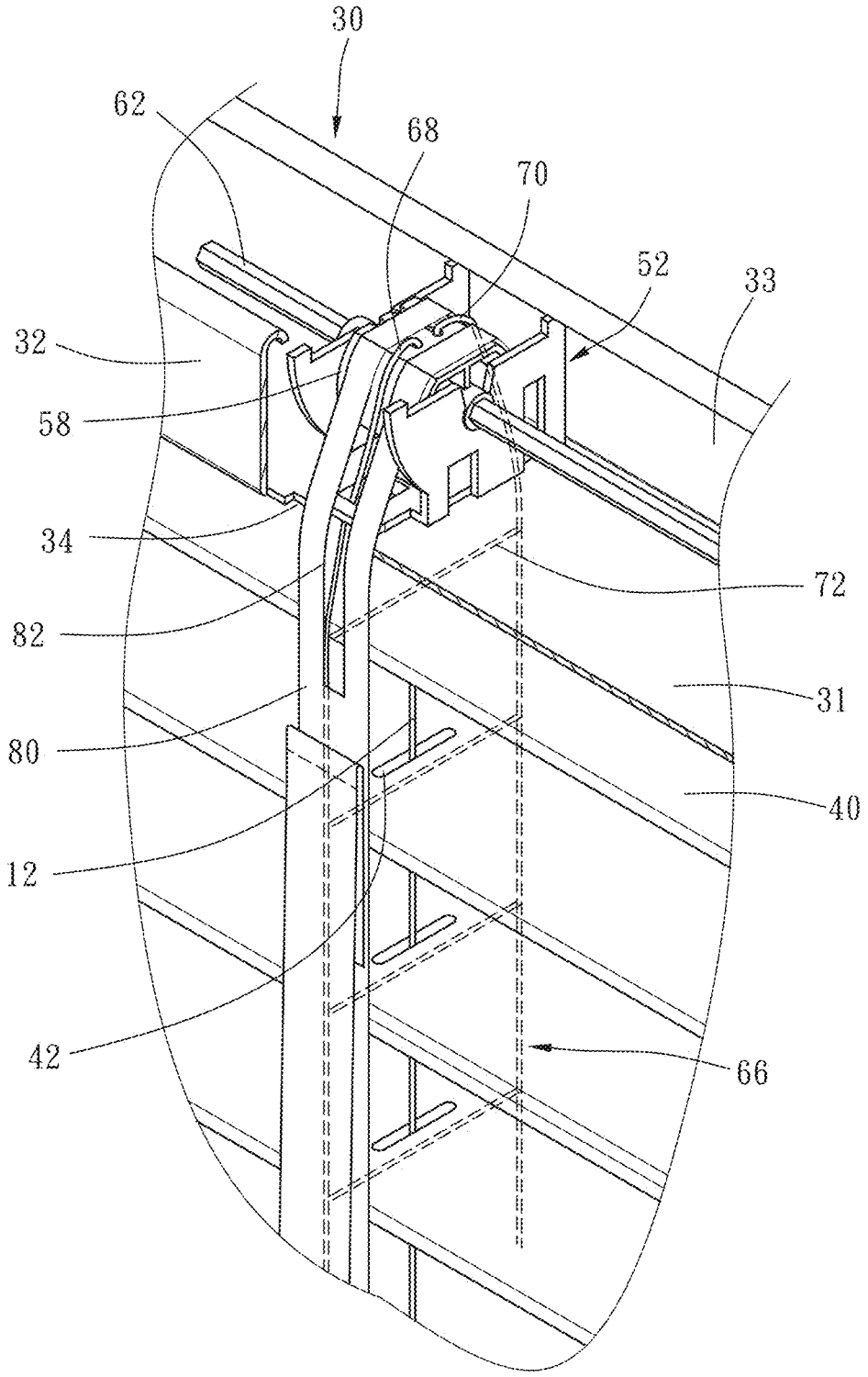
FIG. 3 is a partially enlarged sectional view of FIG. 1, showing the structural relationship between the first drawing member and the first rotary drum.
Figure 5:
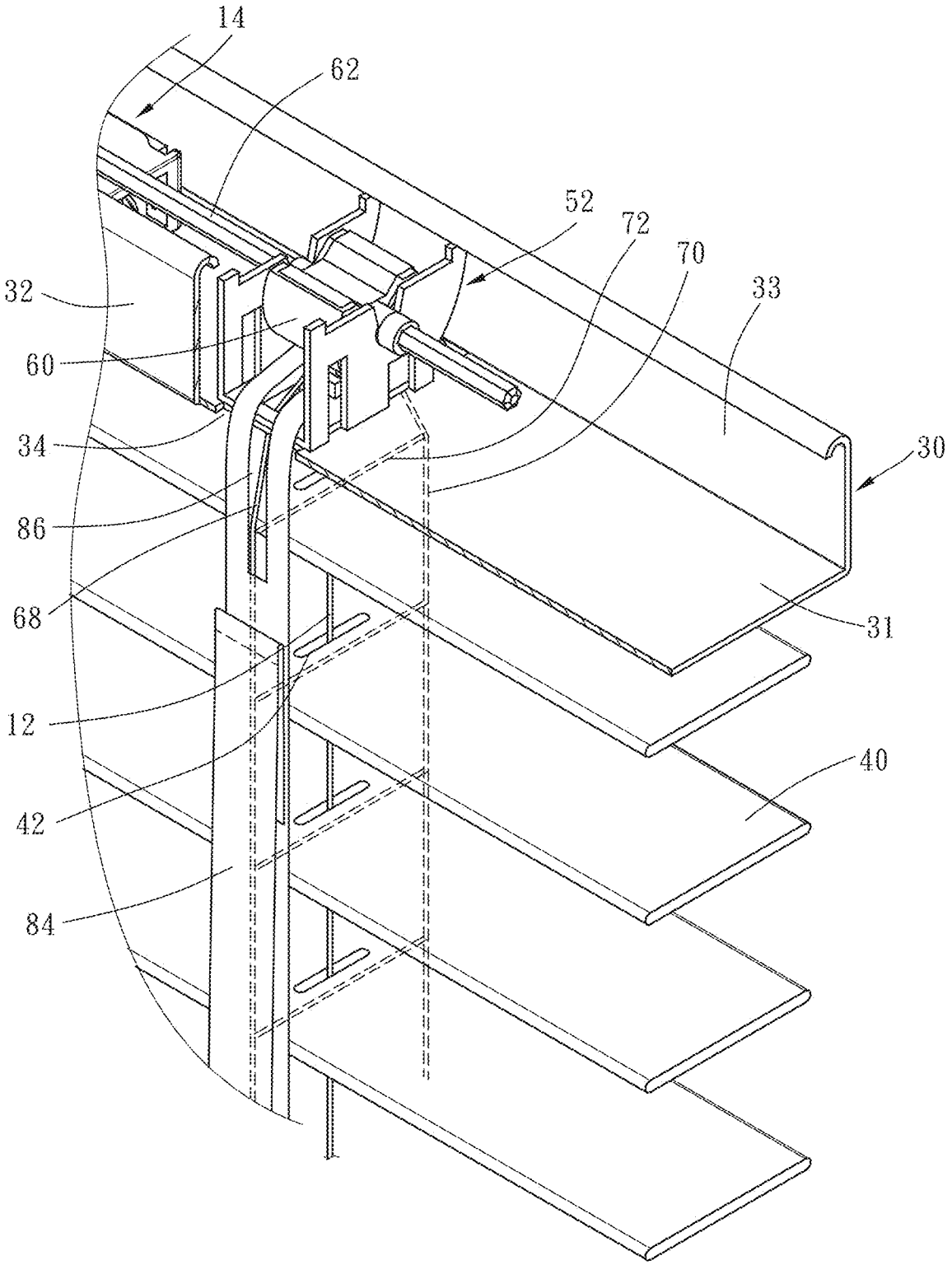
FIG. 5 is a partially enlarged sectional view of FIG. 1, showing the structural relationship between the second drawing member and the second rotary drum.
Figure 7:
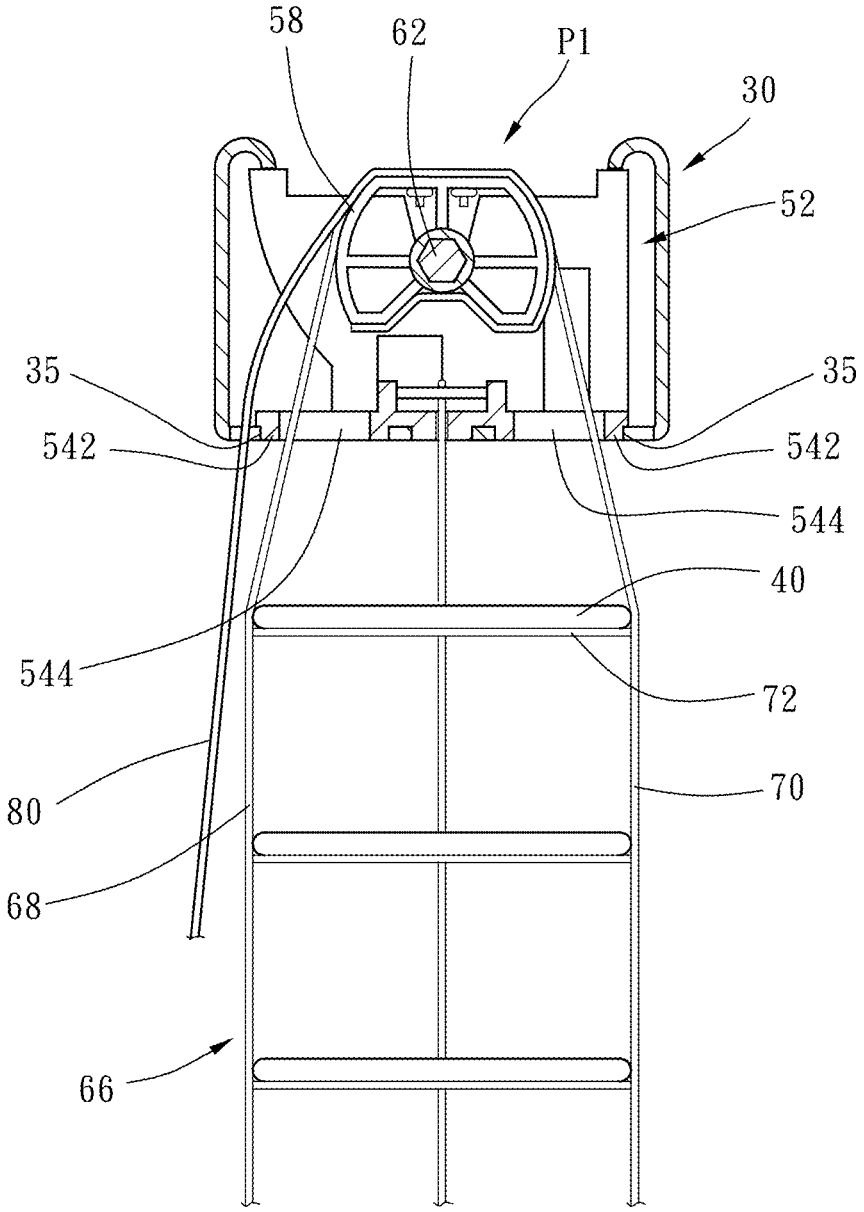
FIG. 7 is a partially sectional end view of the Venetian blind of the present invention, showing the first rotary drum is located at the first position.

As shown in FIGS. 3 and 5, the headrail 30 has a bottom plate 31, a front lateral plate 32 provided with a bottom end thereof vertically connected with the front side of the bottom plate 31, and a rear plate 33 provided with a bottom end thereof vertically connected with the rear side of the bottom plate 31. A through hole 34 and two insertion holes 35 (as shown in FIG. 7) are provided at each of the left and right ends of the bottom plate 31.

The slats 40 are arranged between the headrail 30 and the bottom rail 20 in an evenly spaced manner. As shown in FIGS. 3 and 5, each of the slats 40 has an elongated hole 42 at each of the left and right ends thereof for penetration of a lift cord 12. The two lift cords 12 each have a top end thereof connected with a cord rolling device 14 (which is conventional and not the key point of the invention, the detailed configuration and operational theorem thereof will not be repeatedly mentioned hereunder), and a bottom end thereof connected with the bottom rail 20. When the bottom rail 20 is pushed upwardly by a user, the upward pushing force applied to the bottom rail 20 counteracts the weight of the bottom rail 20 and all the slats 40, enabling the cord rolling deice 14 to roll up the lift cords 12, so that the slats 40 can be folded up stably.

The slat angle adjustment device 50 has two brackets 52, a first rotary drum 58, a second rotary drum 60, a transmission shaft 62, and two ladder cords 66.

Figure 4:
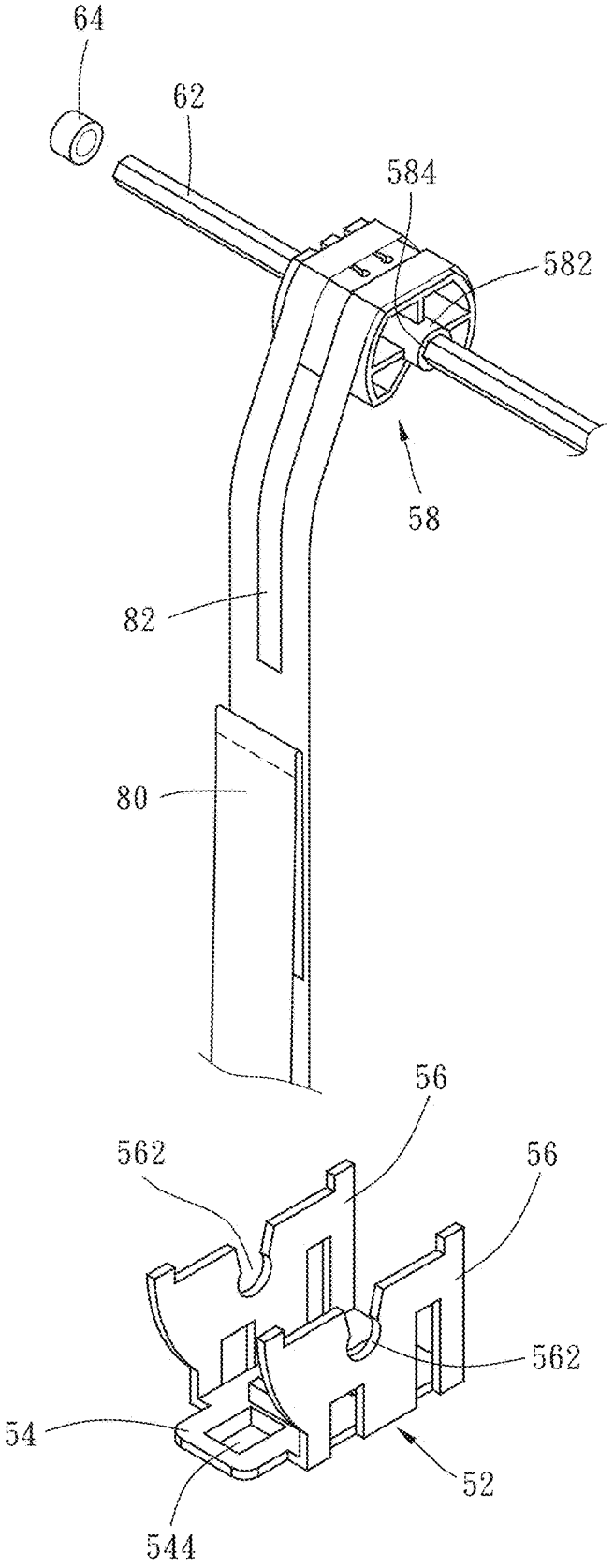
FIG. 4 is a partially exploded perspective view of the slat angle adjustment device and the first drawing member.
Figure 6:
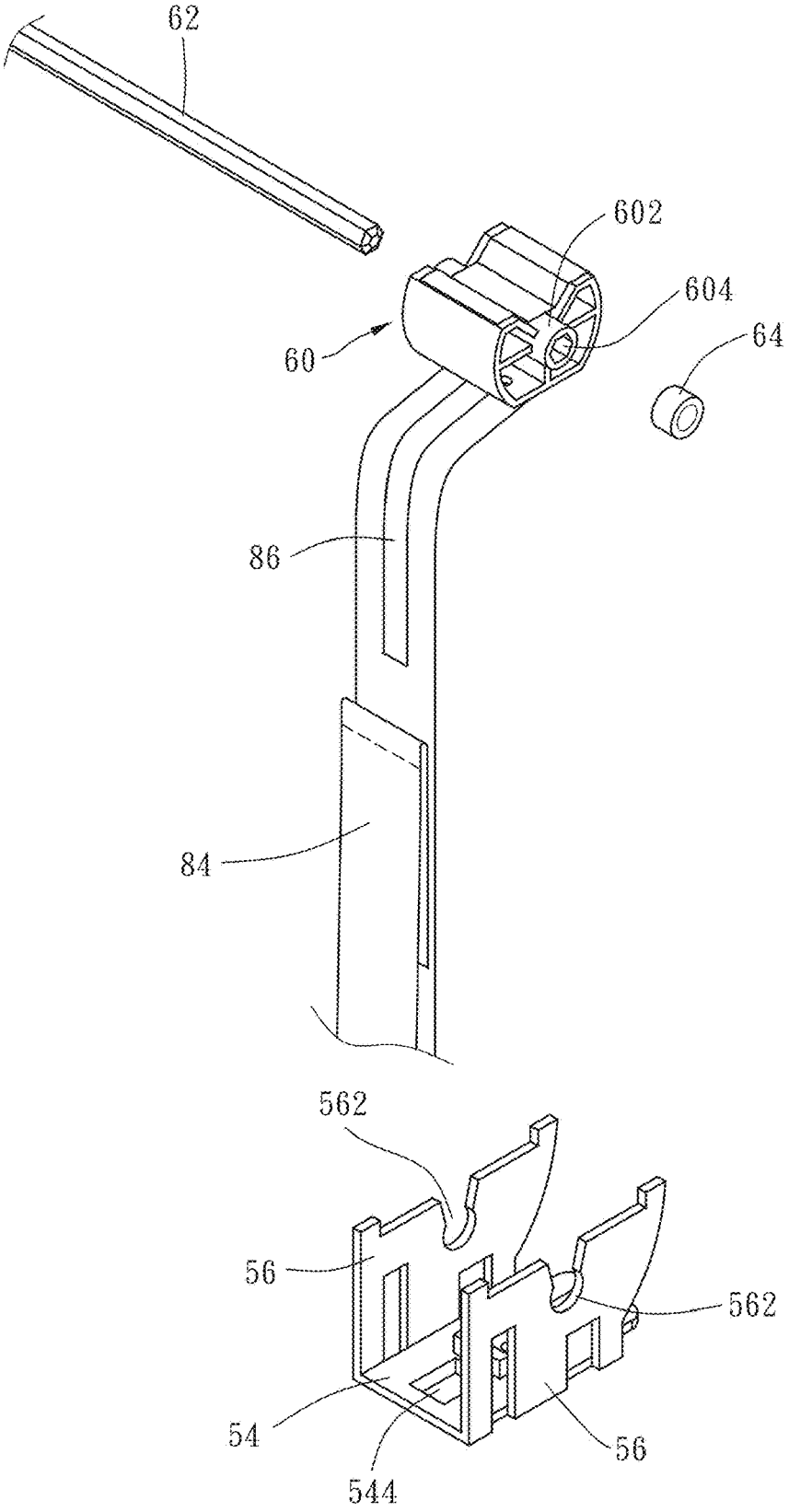
FIG. 6 is a partially exploded perspective view of the slat angle adjustment device and the second drawing member.
Figure 9:
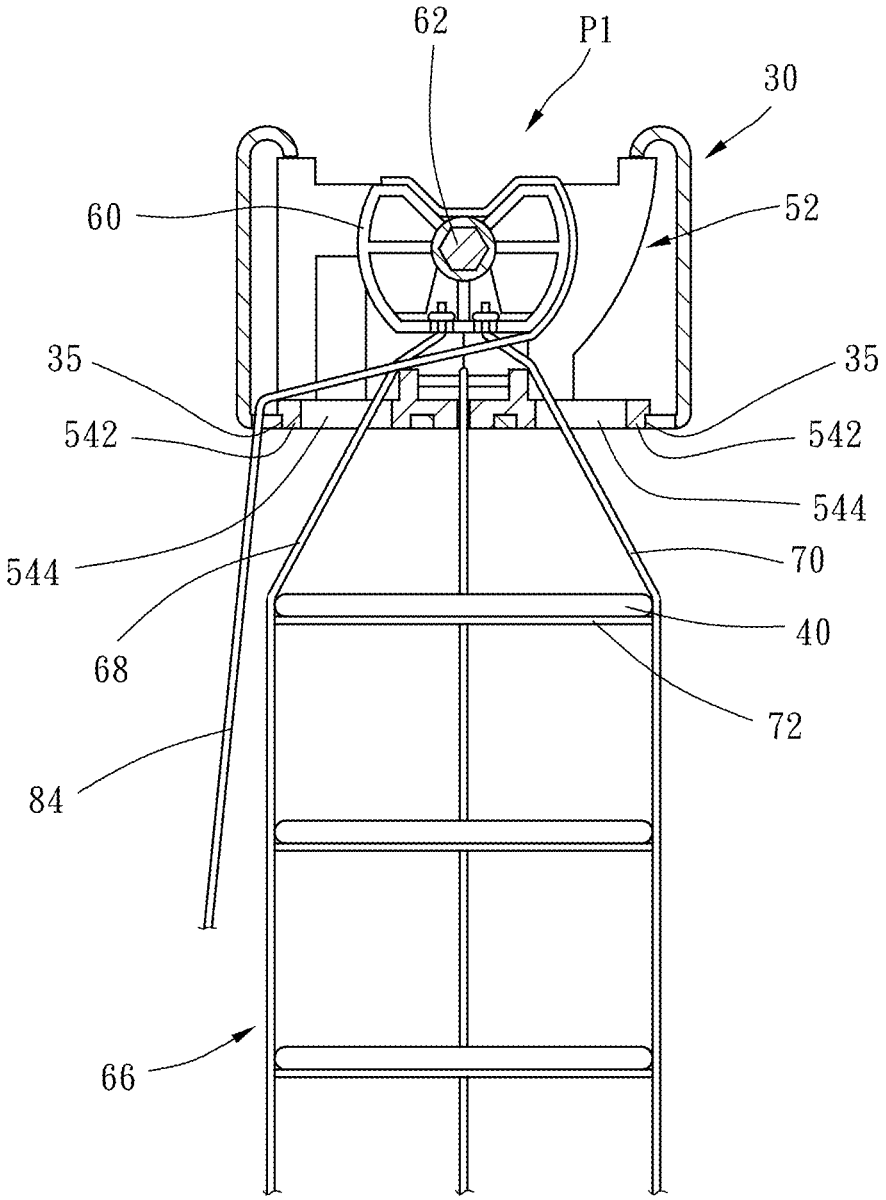
FIG. 9 is a partially sectional end view of the Venetian blind of the present invention, showing the second rotary drum is located at the first position.

As shown in FIGS. 2, 4, and 6, the brackets 52 are located at the left and right ends of the headrail 30, and provided with a bottom wall 54 and two upright walls 56. The bottom wall 54 has two insertion portions 542. Each of the insertion portions 542 is penetrated by a bottom hole 544. The upright walls 56 are connected with the left and right sides of the bottom wall 54, and each have a pivot slot 562 with an opening facing up. As shown in FIGS. 7 and 9, the insertion portions 542 of the bottom walls 54 of the brackets 52 are inserted into the insertion holes 35 of the bottom plate 31 of the headrail 30, and the brackets 52 are arranged in a back-to-front manner.

The first and second rotary drums 58, 60 have the same structures and arranged in an upside-down manner. As shown in FIG. 4, the first rotary drum 58 has a first shaft portion 582 supported by the pivot slots 562 of one of the brackets 52, and a first polygon hole 584 (by taking hexagon as an example) passing through the first shaft portion 582. As shown FIG. 6, the second rotary drum 60 has a second shaft portion 602 supported by the pivot slots 562 of the other of the brackets 52, and a second polygon hole 604 (by taking hexagon as an example) passing through the second shaft portion 602.

As shown in FIG. 2 to 6, the transmission shaft 62 has a polygon cross-section (by taking hexagon as an example). The left and right ends of the transmission shaft 62 are inserted into the first polygon hole 584 of the first rotary drum 58 and the second polygon hole 604 of the second rotary drum 60, such that the first and second rotary drums 58, 60 are rotated synchronously through the transmission shaft 62. Further, two retaining rings 64 are provided at the left and right ends of the transmission shaft 62 for preventing separation of the transmission shaft 62.

Each of the ladder cords 66 has a front warp 68, a rear warp 70, and a plurality of wefts 72 connected between the front and rear warps 68, 70. As shown in FIG. 3 to 5, the front and rear warps 68, 70 of the two ladder cords 66 are located adjacent to the front and rear sides of the slats 40, and the bottom ends of the front and rear warps 68, 70 of the two ladder cords 66 are connected with the bottom rail 20. The top ends of the front and rear warps 68, 70 of one of the ladder cords 66 are connected with the top side of the first rotary drum 58 through the bottom hole 544 of the bottom wall 54 of one bracket 52, and the top ends of the front and rear warps 68, 70 of the other of the ladder cords 66 are connected with the bottom side of the second rotary drum 60 through the bottom hole 544 of the bottom wall 54 of the other bracket 52. Further, each of the wefts 72 is abutted against the bottom side of one respective slat 40.

It deserves to be mentioned that the slat angle adjustment device 50 can provide another bracket 52 and another rotary drum 74 at the middle of the headrail 30 according to actual needs (such as the size of the overall structure). As shown in FIGS. 1 and 2, the third rotary drum 74 is not only assembled with the transmission shaft 62 (the assembly way is the same as the aforesaid rotary drums 58, 60, the detailed configuration will not be repeatedly mentioned hereunder), but is also connected with the third ladder cord 66 (the assembly way is the same as the aforesaid ladder cords 66, the detailed configuration will not be repeatedly mentioned hereunder). By mean of the cooperation of the three rotary drum 58, 60, 74 and the three ladder cords 66, the slats 40 can be tilted more stably.

The first drawing member 80 can be a belt or cord. In this embodiment, the first drawing member 80 is a belt made of leather, cloth or elastic material. As shown in FIG. 2 to 4, the first drawing member 80 is suspended in front of the slats 40 and has a top end thereof passing through the left through hole 34 of the headrail 30 and wound around the top and rear sides of the first rotary drum 58 and adhered to the bottom side of the first rotary drum 58. Further, the first drawing member 80 has a first hollow slot 82 at a top end thereof for receiving parts of the front and rear warps 68, 70 of the left ladder cord 66, which is connected with the first rotary drum 58, thereby avoiding mutual interference between the first drawing member 80 and the front and rear warps 68, 70 of the left ladder cord 66.

The second drawing member 84 can be a belt or cord. In this embodiment, the second drawing member 84 is a belt made of leather, cloth or elastic material. As shown in FIGS. 2, 5 and 6, the second drawing member 84 is suspended in front of the slats 40 and has a top end thereof passing through the right through hole 34 of the headrail 30 and wound around the bottom and rear sides of the second rotary drum 60 and adhered to the top side of the second rotary drum 60. Further, the second drawing member 84 has a second hollow slot 86 at a top end thereof for receiving parts of the front and rear warps 68, 70 of the right ladder cord 66, which is connected with the second rotary drum 60, thereby avoiding mutual interference between the second drawing member 84 and the front and rear warps 68, 70 of the right ladder cord 66.

Figure 8:
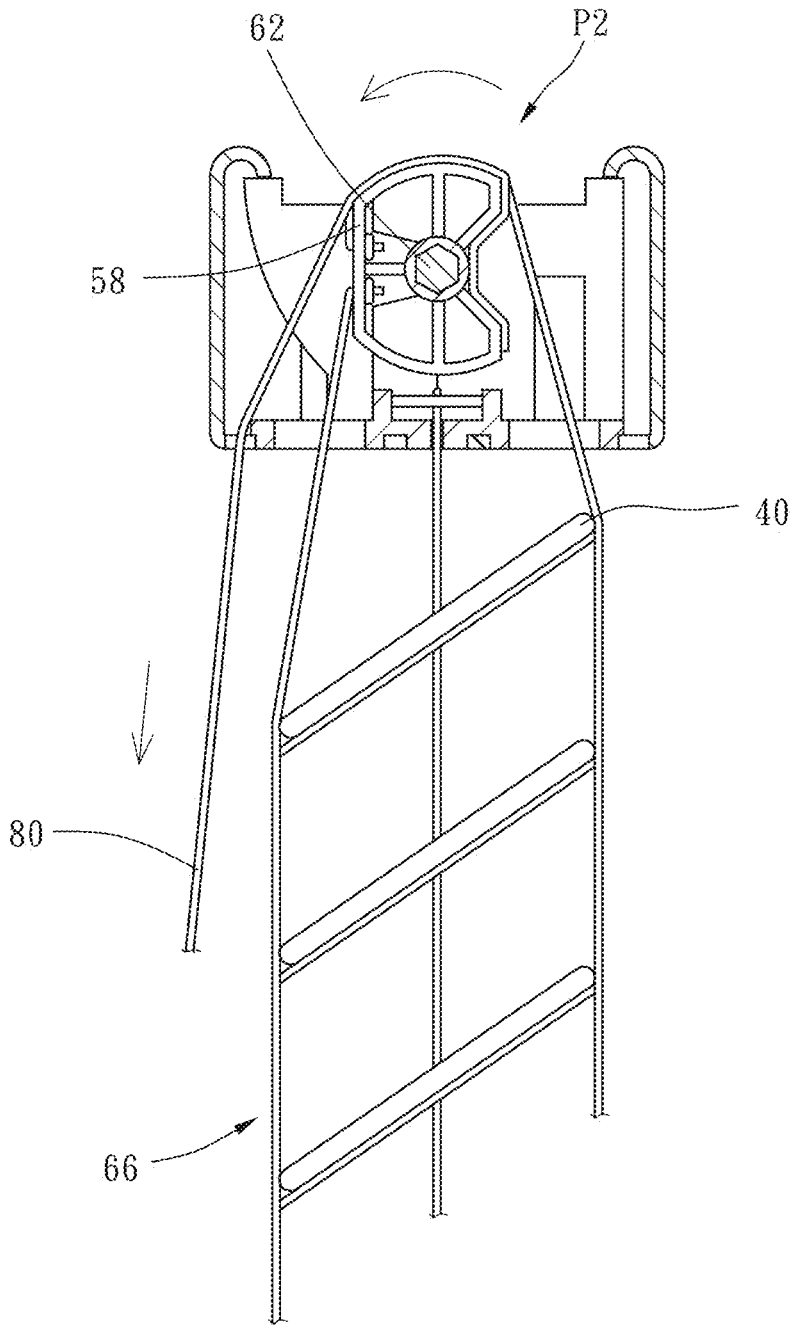
FIG. 8 is similar to FIG. 7, showing the first drawing member is pulled downward.
Figure 10:
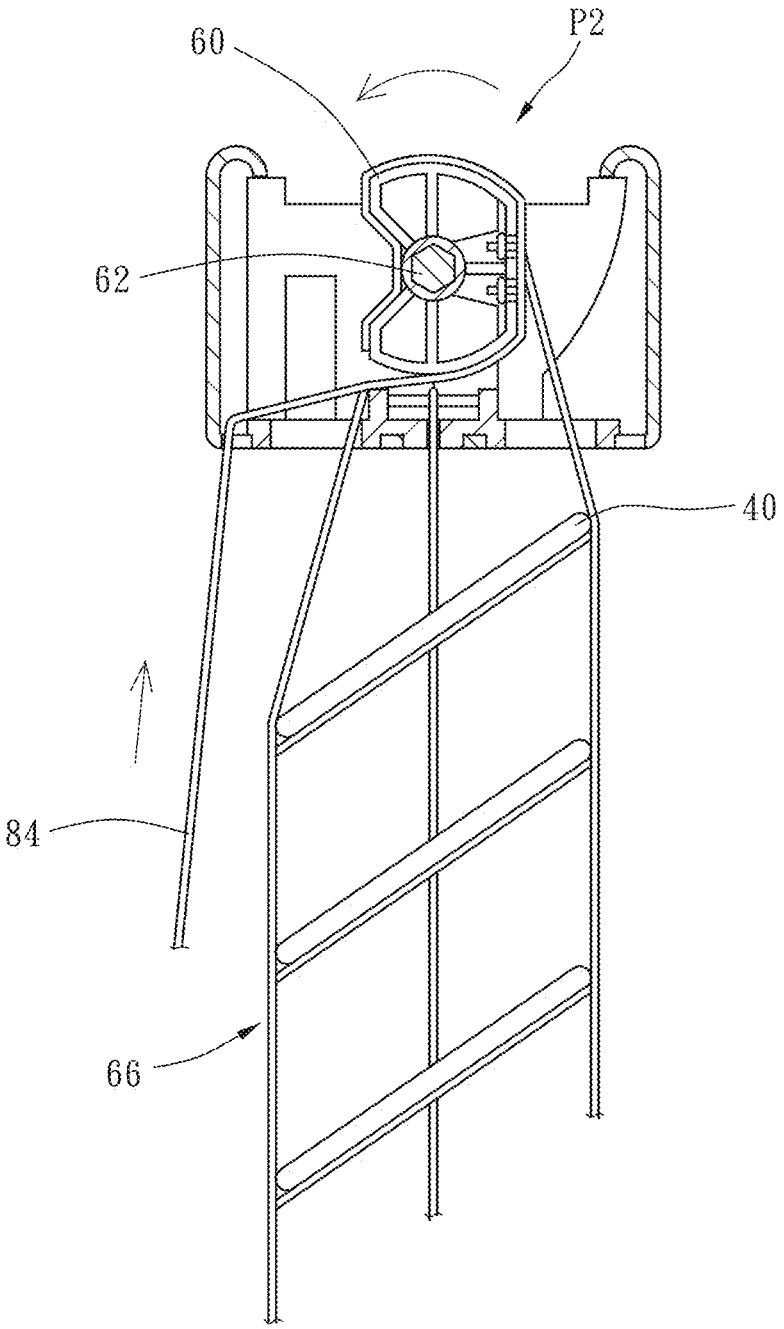
FIG. 10 is similar to FIG. 9, showing the second rotary drum is driven by the transmission shaft to rotate along with the first rotary drum.

If the user would like to close the slats 40, pulling the first drawing member 80 downward to drive the first rotary drum 58 to rotate from a first position P1 as shown in FIG. 7 to a second position P2 as shown in FIG. 8. Since the first and second rotary drums 58, 60 are rotated synchronously through the transmission shaft 62, the second rotary drum 60 is rotated from the first position P1 as shown in FIG. 9 to the second position P2 as shown in FIG. 10, such that a part of the second drawing member 84 is roll around the second rotary drum 60. As a result, the ladder cords 66 are driven by the rotation of the first and second rotary drums 58, 60 to move the slats 40 to a closed position.

Figure 11:
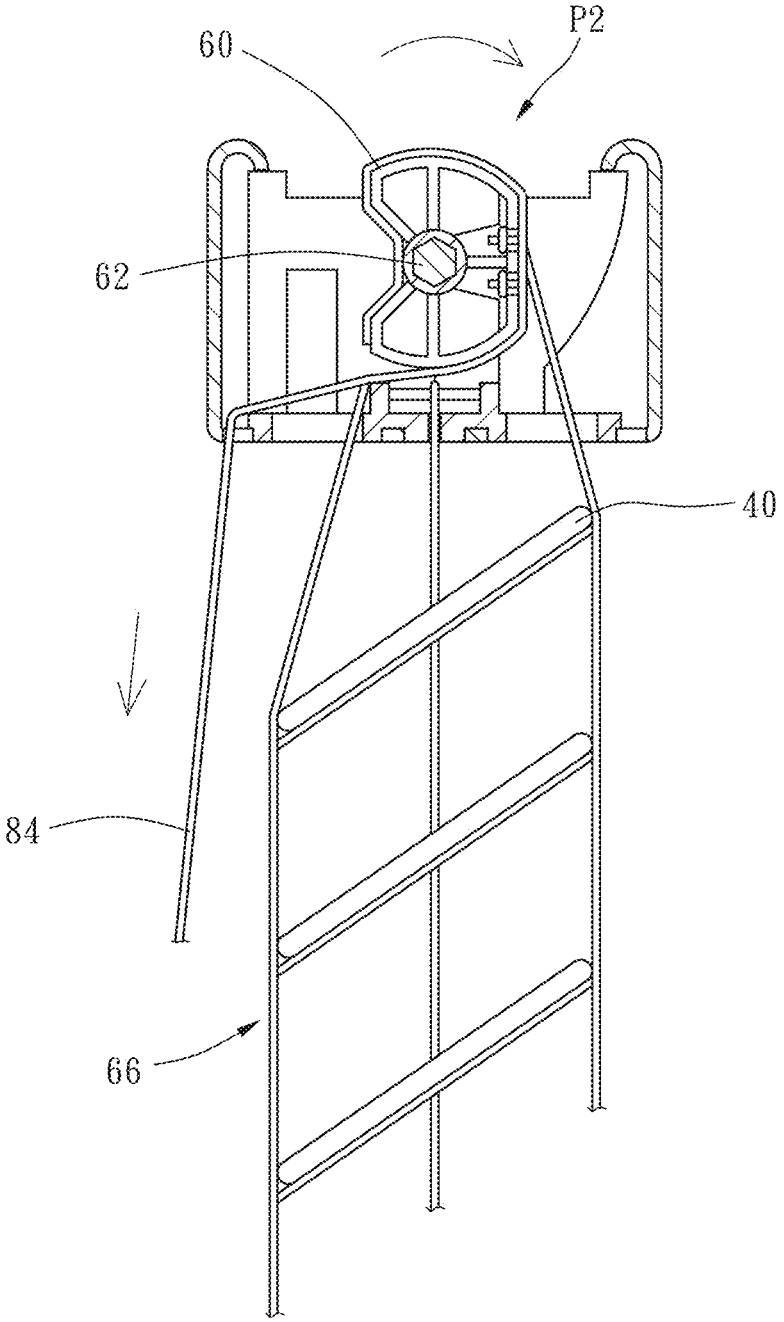
FIG. 11 is similar to FIG. 10, showing the second drawing member is pulled downward.
Figure 12:
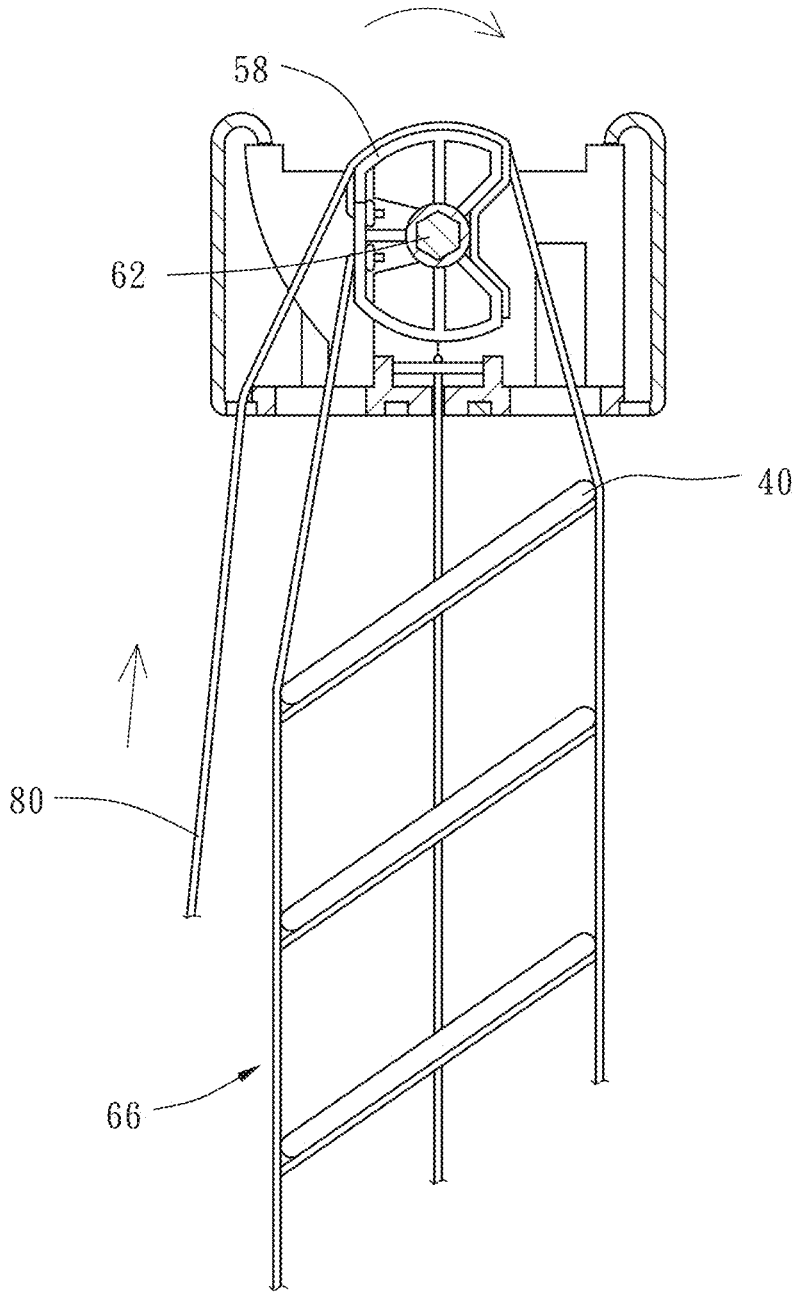
FIG. 12 is similar to FIG. 8, showing the first rotary drum is driven by the transmission shaft to rotate along with the second rotary drum.

If the user would like to open the slats 40, pulling the second drawing member 84 downward to drive the second rotary drum 60 to rotate from the second position P2 as shown in FIG. 11 to the first position P1 as shown in FIG. 9. Since the first and second rotary drums 58, 60 are rotated synchronously through the transmission shaft 62, the first rotary drum 58 is rotated from the second position P2 as shown in FIG. 12 to the first position P1 as shown in FIG. 7, such that a part of the first drawing member 80 is roll around the first rotary drum 58. Therefore, the ladder cords 66 are driven by the rotation of the first and second rotary drums 58, 60 to move the slats 40 to an open position.

As described above, the Venetian blind 10 of the present invention allows the user to close the slats 40 by pulling the first drawing member 80 downward and open the slats 40 by pulling the second drawing member 84, that is to say, the Venetian blind 10 of the present invention has the advantages of simple structure and convenient operation. Further, the first and second drawing members 80, 84 are suspend in front of the slats 40 and made of relative softer material, so this design can prevent the slats 40 from deforming or damaging during packaging or delivery.

What is claimed is:

1. A venetian blind comprising:

a headrail;

a bottom rail;

a plurality of slats arranged between the headrail and the bottom rail;

a slat angle adjustment device having two brackets mounted in the headrail and located at left and right ends of the headrail, a first rotary drum rotatably disposed in one of the brackets, a second rotary drum rotatably disposed in the other of the brackets and connected with the first rotary drum through a transmission shaft, such that the first and second rotary drums are rotated synchronously between a first position and a second position, and two ladder cords each having a front warp, a rear warp, and a plurality of wefts connected between the front and rear warps, wherein the front and rear warps of the ladder cords are located at front and rear sides of the slats, and top ends of the front and rear warps of the ladder cords are connected with the first and second rotary drums, and bottom ends of the front and rear warps of the ladder cords are connected with the bottom rail, and each of the wefts of the ladder cords is abutted against a bottom side of one of the slats, such that when the first and second rotary drums are located at the first position, the ladder cords are driven by the first and second rotary drums to move the slats to an open position, and when the first and second rotary drums are located at the second position, the ladder cords are driven by the first and second rotary drums to move the slats to a closed position;

a first drawing member suspended in front of the slats and having a top end thereof directly connected to the first rotary drum for driving the first rotary drum to rotate from the first position to the second position; and a second drawing member suspended in front of the slats and having a top end thereof directly connected to the second rotary drum for driving the second rotary drum to rotate from the second position to the first position, wherein at least one of the first drawing member or the second drawing member has a hollow slot at a top end thereof through which parts of the front and rear warps of one of the two ladder cords extend to connect to one of the first or second rotary drums.

2. The venetian blind as claimed in claim 1, wherein the first and second drawing members are belts.

3. The venetian blind as claimed in claim 1, wherein the first drawing member is wound around top and rear sides of the first rotary drum and connected with a bottom side of the first rotary drum; the second drawing member is wound around bottom and rear sides of the second rotary drum and connected with a top side of the second rotary drum.

4. The venetian blind as claimed in claim 1, wherein the headrail is provided with two through holes at left and right ends thereof for penetration of the first and second drawing members.

* * * * *